United States Patent [19]

Press

[11] 4,143,894

[45] Mar. 13, 1979

[54] METHOD OF MAKING DECORATIVE RING LINKS AND ARTICLE PRODUCED THEREBY

[76] Inventor: Louis H. Press, 1225 E. 68th St., Brooklyn, N.Y. 11234

[21] Appl. No.: 870,029

[22] Filed: Jan. 16, 1978

[51] Int. Cl.[2] ..... D04G 5/00; B65H 69/04

[52] U.S. Cl. ..... 289/1.2; 289/1.5; 289/18 R

[58] Field of Search ..... 289/18 M, 1.2, 1.5; 87/8, 10, 11, 12, 13, 53

[56] References Cited

U.S. PATENT DOCUMENTS

| | | | |
|---|---|---|---|
| 2,781,062 | 2/1957 | White | 87/8 X |
| 3,204,519 | 9/1965 | Lawson et al. | 87/8 |

OTHER PUBLICATIONS

"Macrame' Start to Finish", Craft Course Publishers Inc., Temple City, Ca., 1971, pp. 2, 7.

"The Ashley Book of Knots", by C. W. Ashley; Doubleday & Co., Inc., Garden City, N.Y., 1946, pp. 400, 401.

"Encyclopedia of Knots", by R. Graumont et al.; Cornell Maritime Press, N. Y., 1945, pp. 304, 305, 364, 366, 394, 395.

*Primary Examiner*—Louis Rimrodt

*Attorney, Agent, or Firm*—Kenneth P. Glynn

[57] ABSTRACT

The present invention is directed to a method of making a decorative ring link and to the resulting article. The method involves: placing a first piece of lacing and a second piece of lacing in substantially parallel alignment; bending the pieces of lacing so that each piece has a longer strand and a shorter strand; binding, e.g. by taping, the pieces at a location so as to cause the bent portion of each of the pieces of lacing to form an open eyelet portion above the binding location and so as to leave a longer strand and a shorter strand of each piece below the binding location, the longer strand of the first piece being a looper and the longer strand of the second piece being a weaver; knotting the longer strands about the shorter strands; repeating the knot-forming steps to form a plurality of knots cutting through each piece of lacing at its eyelet portion so that each shorter strand becomes separate from its corresponding longer strand; forming an endless ring by inserting one end of at least one short strand under one or more knots located at the distant end therefrom; and, continuing to form knots about said shorter strands according to the procedure above, at least until the last formed knot is formed substantially contiguously to the first formed knot.

10 Claims, 14 Drawing Figures

METHOD OF MAKING DECORATIVE RING LINKS AND ARTICLE PRODUCED THEREBY

BACKGROUND OF THE INVENTION

1. Field of the Invention

The present invention is directed to a method of making a decorative ring link and to the article made by that method. More particularly, the present invention is directed to a method of making a decorative ring link, and to the resulting article, utilizing a novel sequence of steps including the formation of a plurality of unique knots.

2. Prior Art Statement

Various knots have been used by man for many thousands of years, and historians tell us that some relatively sophisticated knots were used in basket weaving and similar arts more than five thousand years ago. Notwithstanding the technological advances made by man in the last two centuries and the replacement of basic hand skills with automation, the arts of knot making and rope and lace weaving remain vibrant. Indeed, as the need for these skills in terms of survival and productivity diminished, the enjoyment of practicing these arts as hobbies or as means of producing art, increased. Although there exists a formidable body of knowledge in this field, the very nature of knot making and lace weaving admits to an infinite number of possibilities. Thus, while these arts have been around for literally thousands of years, enthusiastic artisans today strive to develop new and unusual concepts that will enhance the arts.

The Ashley Book of Knots, Clifford W. Ashley; Doubleday and Company, Inc. (New York, New York: 1946) exemplifies the knot making art and illustrates occupational knots (page 61) useful in making, for example, jewelry, and illustrates various macrame and artistic knots (pages 400–401) useful in making various types of lacings including belts, handbags, lanyards, leases, etc. An article by Albert Palmer "Warp Breakage — A Study of Its Importance and Elimination" reprinted from the April, 1935 issue of Cotton (Atlanta, Georgia) describes various knots used in weaving and knot making, with illustrations. U.S. Pat. No. 2,888,682 (DuBois et al.) illustrates a method of making a shoulder cord comprised of a closed loop of ornamental character including a series of repeated knots made about a continuous ring. Of these references, none teaches a knot which is similar to or renders obvious the knot used in the method and article of the present invention. Further, none teaches a combination of steps which is similar to or which render obvious the combination of steps used in the method of the present invention. In fact, it is believed that the method and article of the present invention are totally new to and unobvious over the entire knot making and lace weaving body of art.

BRIEF DESCRIPTION OF THE PRESENT INVENTION

The present invention is directed to a method of making a decorative ring link and to the resulting article. The method involves: placing a first piece of lacing and a second piece of lacing in substantially parallel alignment; bending the pieces of lacing so that each piece has a longer strand and a shorter strand; binding, e.g. by taping, the pieces at a location so as to cause the bent portion of each of the pieces of lacing to form an open eyelet portion above the binding location and so as to leave a longer strand and a shorter strand of each piece below the binding location, the longer strand of the first piece being a looper and the longer strand of the second piece being a weaver; forming a loop to one side of the shorter strands with the looper by arcing it away from and then transversly in front of the shorter strands; passing the weaver in front of the looper; then passing it behind the shorter strands and then weaving it through the loop formed by the looper; pulling the looper and the weaver so as to tighten a resulting knot about the shorter strands; repeating the knot-forming steps to form a plurality of knots but alternating the side of the short strands on which the loop is formed for each subsequent knot; cutting through each piece of lacing at its eyelet portion so that each shorter strand becomes separate from its corresponding longer strand; forming an endless ring by inserting one end of at least one short strand under one or more knots located at the distant end therefrom; and, continuing to form knots about said shorter strands according to the procedure above, at least until the last formed knot is formed substantially contiguously to the first formed knot.

DETAILED DESCRIPTION OF THE PRESENT INVENTION

The method of the present invention may be employed to produce a decorative ring link of virtually any diameter and thickness, depending on the choice of starting material length and thickness. In general, the method is used to produce the decorative ring link from pieces of lacing. By "lacing" as used herein is meant any flexible strand-like material that may be knotted. Thus lacing includes strings, ropes, plastic cords, extruded synthetics, natural strandings and bindings as well as flexible metallic and metallized strands. The well-known plastic lacings having a flattened cross-section and sold at most hobby stores is among the preferred lacings which may be used in the present invention.

The first step in the method of the present invention involves placing a first piece of lacing and a second piece of lacing in substantially parallel alignment. These two pieces may be approximately the same length or they may be different lengths and any excess may, if desired, be trimmed during the making of or after completing the decorative ring link. The alignment step is used merely to create a frame of reference between the two pieces of lacing and to facilitate subsequent manipulative steps. Thus, the alignment may be effected in any manner, e.g. by hand with visiual observations, as long as the two pieces of lacing end up, at least for a portion, in substantially parallel or longitudinal alignment.

The second step in the method of the present invention involves bending the two pieces of lacing so that each piece has a longer end and a shorter end. This is meant to result in the longer end of the first piece of lacing being substantially parallel to and substantially contiguous to the longer end of the second piece of lacing, and to effect a similar relationship between the shorter end of each of the two pieces of lacing.

The third step involves binding the two pieces of lacing at a location below the bend so as to cause the bent portion of each of the two pieces of lacing to form an open eyelet portion above the binding location and so as to leave remaining below the binding location a longer strand and a shorter strand of each of the two pieces of lacing. Thus binding may be achieved by tying the pieces with a string or wire or by taping the pieces with a tape or by any other binding technique, including squeezing or holding the pieces of lacing in a binding fashion with a tool or even by hand. Binding with a wire, string or tape, however, appears to afford a good degree of flexibility and manipulation in practicing the subsequent steps in the method. For convenience in describing these subsequent steps, the longer strand of the first piece of lacing is arbitrarily referred to as a looper and the longer strand of the second piece of lacing is referred to as a weaver.

The fourth step in the method of the present invention involves forming a loop to one side of the shorter strands of the pieces of lacing with the looper by arcing it away from and then transversely in front of the shorter strands. Sufficient length of the looper should be left to this one side of the shorter strands so as to permit the passage of lacing through the loop which is formed. The next step, in fact, involves the passing of the weaver over the looper, then behind the shorter strands, and then weaving it through the loop formed by the looper. Next, the looper and the weaver are pulled, e.g. in opposite or otherwise different directions, so as to tighten a resulting knot which is created by the foregoing steps about (around) the shorter strands.

The procedure of forming the loop with the looper and then manipulating the weaver as described so as to form a resulting knot, is repeated to form a plurality of knots, except that the side of the short strands on which the loop is formed is alternated for each subsequent knot. This is inherent because the looper ends up on the side opposite its previous position upon completion of a knot.

After a plurality of knots have been made, e.g. three to ten or more, each of the two pieces of lacing are cut through at its eyelet portion so that each shorter strand becomes separate (i.e. now has two ends) from its corresponding longer end. While the exact point of cutting is not critical, it is convenient to cut the pieces at about the middle of the eyelet so as to leave the ends exposed and more easily graspable.

Once the cutting is complete, at least one of the shorter strands, and in a preferred embodiment both of the shorter strands, is shaped into an endless ring by being shaped into a substantially circular or other continuous form, and inserting one end thereof under one or more knots located at the distant end therefrom.

The last essential step in the method of the present invention involves the continuing formation of additional knots by the steps described above, at least until the knots cover the entire exposed ring of shorter strand(s), i.e. at least until the last formed knot is formed substantially contiguously to the first formed knot. Thereafter, additional optional knots may be made, as desired, overlaying the first ring of knots to achieve an otherwise thicker decorative ring link.

Thereafter, additional optional steps may be performed. For example, in order to enhance the appearance of the article obtained, any extraneous ends, either from the shorter strands or the longer strands, may be cut, e.g. as closely as possible to the lacing forming the decorative ring link without destroying the integrity thereof.

Also, a plurality of decorative ring links may be formed, with one looped through the next, so as to form a chain. In one embodiment, this chain may be interlinked so that the last decorative ring link formed is looped through the first ring link so as to form an endless chain.

The following description of the drawings and examples are presented for illustrative purposes, and the present invention should not be construed to be limited thereto:

DETAILED DESCRIPTION OF THE DRAWINGS AND EXAMPLES

Figure 1:
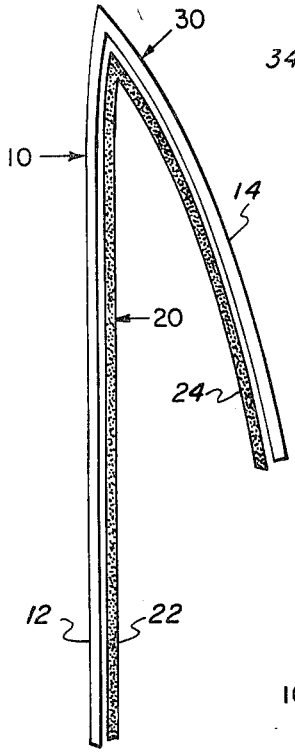
FIGS. 1–4 illustrate the starting steps and the formation of the first knot in one embodiment of the method of the present invention.

FIG. 1 shows a first piece of lacing generally as 10 and a second piece of lacing generally as 20. The first piece 10 and the second piece 20, are placed in substantially parallel alignment and are bent at a location shown generally at 30. This bending is such that first piece 10 and second piece 20 have longer strands 12 and 22, respectively, and shorter strands 14 and 24, respectively.

Figure 2:
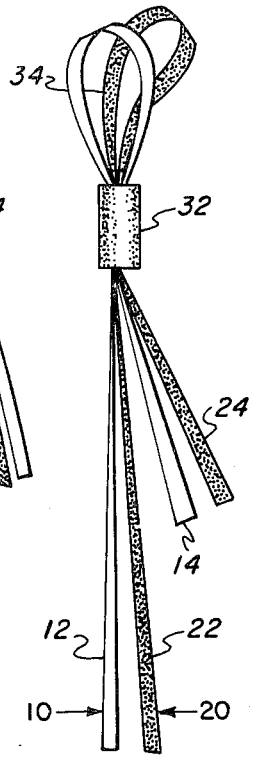

FIG. 2 shows the pieces 10 and 20 of FIG. 1 (like parts are like numbered throughout) bound with tape 32 at a location so as to cause the bent portion of each of the pieces 10 and 20 to form an open eyelet portion above the binding location. The eyelet portion shown as the general area 34 is formed so as to leave a longer strand (12 and 22) and a shorter strand (14 and 24) for the first piece (10) and the second piece (20) of lacing. The longer strand 12 of the first piece 10 will hereinafter be referred to as looper 12, and the longer strand 22 of the second piece 20 will hereinafter be referred to as weaver 22.

Figure 3:
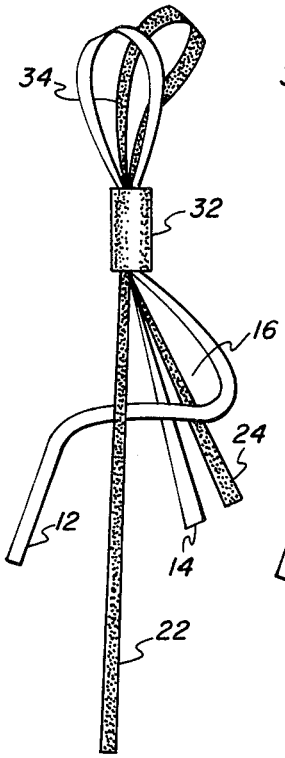

The looper 12 and the weaver 22 are illustrated in FIG. 3 to show the next step in the method of the present invention. As shown, looper 12 is positioned to form a loop 16 to the right side of shorter strands 14 and 24 by arcing looper 12 away from (to the right) and then transversely in front of shorter strands 14 and 24. The weaver 22, if it does not inherently end up there, is passed in front of looper 12, as shown in FIG. 3.

Figure 4:
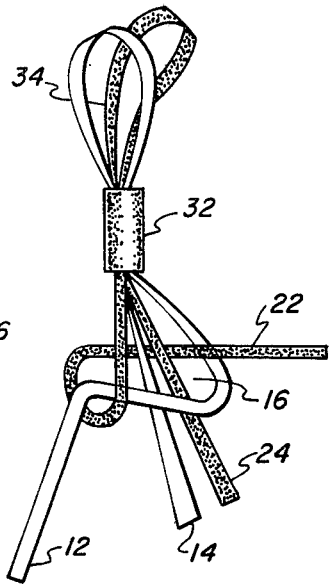

Next, as illustrated in FIG. 4, after weaver 22 is passed in front of looper 12, weaver 22 is passed behind shorter strands 14 and 24 and is then woven through loop 16 formed by looper 12. Next, looper 12 and weaver 22 are pulled, in divergent directions, e.g. in opposite directions, so as to tighten a resulting knot about shorter strands 14 and 24.

Figure 5:
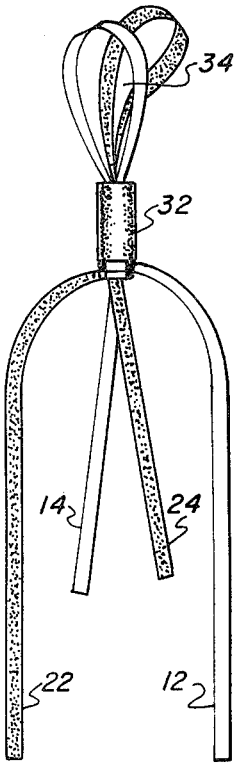
FIGS. 5–9 illustrate the formation of subsequent knots and the cutting of the eyelet portions of the pieces of lacing in one embodiment of the method of the present invention.

The foregoing knot-forming steps are repeated but forming a loop to the left of shorter strands 14 and 24. The resulting two knotted article is shown in FIG. 5.

Figure 6:
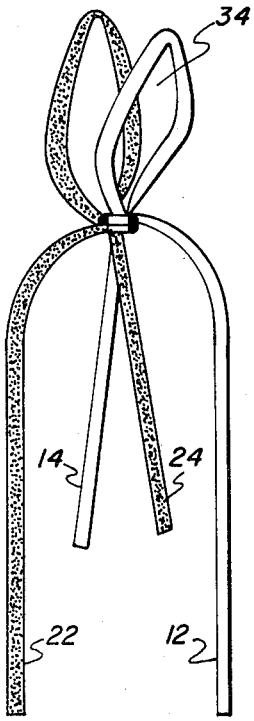
Figure 7:
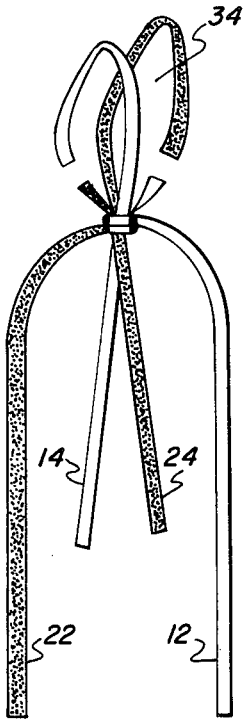

After a plurality of knots are formed, e.g. two to twenty or more, and in this illustrated embodiment, after two knots have beem formed, the binding material, i.e. tape 32, is removed, as shown in FIG. 6 and the pieces of lacing are cut through at eyelet portion 34 as shown in FIG. 7.

Next, additional knots are formed using the above-described knot-forming steps, except that the side of shorter strands 14 and 24 on which the loop is formed is alternated for each subsequent knot. These additional knots are shown in FIGS. 8 and 9 generally as 40.

Figure 10:
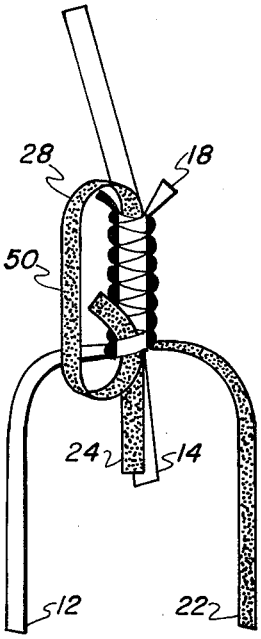
FIGS. 10–12 illustrate the formation of the endless ring and the final steps in completing a decorative ring link made by one embodiment of the method of the present invention.

FIG. 10 illustrates the next step in which one end of shorter strand 24 is inserted under one knot located at the distant end therefrom so as to form an "endless ring" shown generally as 50.

Figure 8:
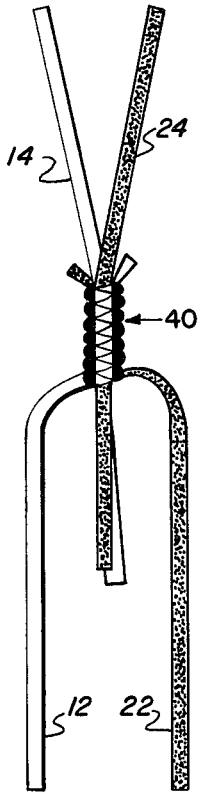
Figure 9:
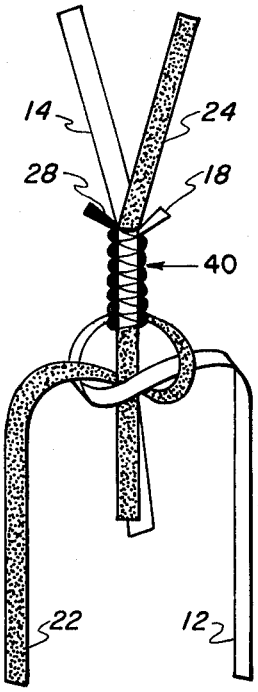

It should be noted that FIGS. 7, 8 and 9 illustrate cutting, knot-forming, and then endless ring forming. In fact, it is not critical to the present invention that knots be formed between the steps of cutting and endless ring forming. Thus, for example, many more knots than two could have been formed prior to cutting, or not, and, in either case, the endless ring forming could be performed sequentially following the cutting.

Figure 11:
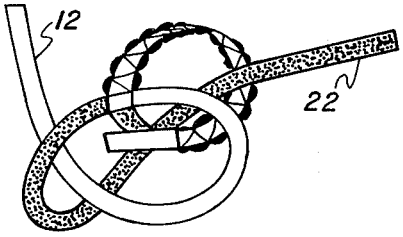

After the endless ring is formed as shown in FIG. 10, extraneous ends (e.g., 18 and 28 shown in FIG. 10) may be cut off to make the article more attractive, as shown in FIG. 11. An optional, albeit advantageous, step involves cutting the end or ends of shorter strand 14 so as to render shorter strand 14 approximately equal in length to the perimeter of the endless ring. Whether or not this optional step is included, the next step involves the formation of additional knots, as shown in FIG. 11, following the mentioned procedure.

Figure 12:
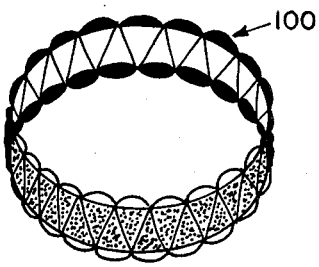

The knots are formed about the shorter strands 14 and 24 and therefore about endless ring 50 at least until the last to be formed knot reaches and is thus contiguous to the first to be formed knot. Extraneous pieces are then optionally cut, as desired. The finished article is shown as 100 in FIG. 12.

Figure 13:
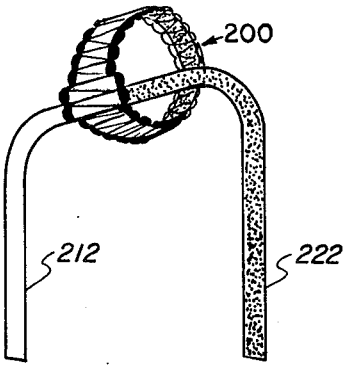
FIG. 13 illustrates an embodiment wherein a second layer of knots is being formed over the first layer of knots of a decorative ring link of the present invention; and, FIG. 14 illustrates schematically an endless chain formed of a plurality of joined decorative ring links of the present invention.

In another embodiment of the present invention, longer strands are established at the onset with excessive length so that a second or more layer(s) of knots may be formed about the first layer of knots. This is illustrated in FIG. 13, in which decorative ring link 200 contains a completed first layer of knots and a second layer of knots is being formed with looper 212 and weaver 222. The finishing may be as described above.

Figure 14:
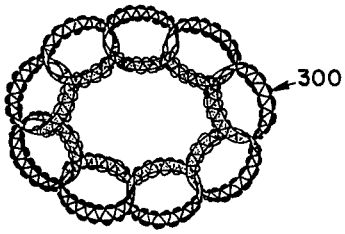

In another embodiment of the present invention, a series of decorative ring links are made so as to be joined to one another. For example, sufficient decorative ring links may be joined to one another to form a wristlet, a necklace, a belt, a strap, or other fashionable and/or functional article, and metal or other components may be included, e.g. by being looped or woven through during the knot making step. These components include metal hooks, clasps, cameos, pins and other decorative and/or functional jewelry parts within the purview of the artisan. In one preferred embodiment, the decorative ring links are joined to one another so as to form an endless chain by joining the first to be joined decorative ring link in a chain with the last to be joined decorative ring link, as shown generally in FIG. 14 as 300.

Other variations should now be evident to the artisan without exceeding the scope of the present invention.

What is claimed is:

1. A method of making a decorative ring link comprising:

(a) placing a first piece of lacing and a second piece of lacing in substantially parallel alignment;

(b) bending said pieces of lacing so that each piece has a longer strand and a shorter strand;

(c) binding said pieces of lacing at a location so as to cause the bent portion of each of said pieces of lacing to form an open eyelet portion above said location and so as to leave a longer strand and a shorter strand of each piece below said location, the longer strand of the first piece being a looper and the longer strand of the second piece being a weaver;

(d) forming a loop to one side of the shorter strands of said pieces with said looper by arcing it away from and then transversely in front of said shorter strands;

(e) passing said weaver over said looper, then passing it behind said shorter strands and then weaving it through the loop formed by said looper;

(f) pulling said looper and said weaver so as to tighten a resulting knot about said shorter strands;

(g) repeating the procedure of steps (d) through (f) but forming the loop on the side of the shorter strands opposite from the side where the previous loop was formed;

(h) repeating the procedure steps (d) through (g) so as to form a plurality of resulting knots about said shorter strands;

(i) cutting through each piece of lacing at its eyelet portion so that each shorter strand becomes separate from its corresponding longer strand;

(j) forming an endless ring by inserting one end of at least one shorter strand under one or more knots located at the distant end therefrom; and, (k) continuing to form additional knots about said shorter strands, at least until the last formed knot is formed substantially contiguously to the first formed knot.

2. The article made by the method of claim 1.

3. The method of claim 1 wherein any extraneous ends are cut as close as possible to the lacing forming said decorative ring link without destroying the integrity of said decorative ring link.

4. The article made by the method of claim 3.

5. The method of claim 1 wherein an additional plurality of knots are formed about said knots forming said decorative ring link so as to create a plurality of layers of knots.

6. The article made by the method of claim 5.

7. The method of claim 1 wherein a plurality of said decorative ring links are made so as to form a chain.

8. The article made by the method of claim 7.

9. The method of claim 7 wherein said chain is an endless chain.

10. The article made by the method of claim 9.

* * * * *